US008061248B2

(12) United States Patent
Svensson

(10) Patent No.: US 8,061,248 B2
(45) Date of Patent: Nov. 22, 2011

(54) MACHINE FOR SLITTING PLANE PACKAGING BLANKS

(75) Inventor: Mikael Svensson, Haverdal (SE)

(73) Assignee: Inter IKEA Systems B.V., Delft (NL)

( * ) Notice: Subject to any disclaimer, the term of this patent is extended or adjusted under 35 U.S.C. 154(b) by 194 days.

(21) Appl. No.: 10/562,178

(22) PCT Filed: Jun. 25, 2004

(86) PCT No.: PCT/IB2004/002133

§ 371 (c)(1),
(2), (4) Date: Jul. 31, 2006

(87) PCT Pub. No.: WO2005/000546

PCT Pub. Date: Jan. 6, 2005

(65) Prior Publication Data

US 2007/0125218 A1 Jun. 7, 2007

(30) Foreign Application Priority Data

Jun. 27, 2003 (DK) ..... 2003 00975

(51) Int. Cl.
*B26D 1/12* (2006.01)

(52) U.S. Cl. ..... 83/332; 83/671; 83/673; 83/677

(58) Field of Classification Search ..... 83/332, 83/343, 346, 345, 500, 673, 699, 676; 493/354, 493/471, 464, 365
See application file for complete search history.

(56) References Cited

U.S. PATENT DOCUMENTS

| | | | | | |
|---|---|---|---|---|---|
| 2,201,184 | A | * | 5/1940 | Knowlton | 83/346 |
| 3,293,962 | A | * | 12/1966 | Gianaris | 83/332 |
| 3,895,549 | A | * | 7/1975 | Noda et al. | 83/345 |
| 4,098,173 | A | | 7/1978 | Schauman | |
| 5,002,524 | A | * | 3/1991 | Mills | 493/354 |
| 5,181,899 | A | * | 1/1993 | Hill et al. | 493/34 |
| 5,386,753 | A | * | 2/1995 | Baron et al. | 83/335 |
| 5,546,838 | A | * | 8/1996 | Longwell | 83/37 |
| 5,596,918 | A | * | 1/1997 | Longwell et al. | 83/332 |
| 2001/0009121 | A1 | * | 7/2001 | Benzoni | 83/499 |

FOREIGN PATENT DOCUMENTS

| | | | |
|---|---|---|---|
| EP | 1120209 | | 8/2001 |
| GB | 2302834 A | * | 2/1997 |
| WO | WO 00/02715 | * | 1/2000 |

OTHER PUBLICATIONS

Sep. 22, 2005 International Preliminary Examination Report in connection with PCT International Application No PCT/IB2004/002133.

* cited by examiner

*Primary Examiner* — Ghassem Alie
(74) *Attorney, Agent, or Firm* — Cooper & Dunham LLP

(57) ABSTRACT

A machine for slitting plane packaging blanks includes at least one rotatable slitting roller with at least one knife for producing a front edge slit and/or a rear edge slit in each packaging blank. The knife is sector-shaped, and defined by two knife end edges. A first knife portion adjacent a first knife end edge is adapted to cut the front edge slit out in a front edge of the blank. A second knife portion adjacent a second knife end edge is adapted to cut a rear edge slit out in a rear edge of the blank and rearwards through the rear edge while the blank is advanced through the machine at a uniform speed.

7 Claims, 4 Drawing Sheets

MACHINE FOR SLITTING PLANE PACKAGING BLANKS

TECHNICAL FIELD

The invention relates to a machine for slitting plane packaging blanks, especially packaging blanks made of corrugated board, said machine including a driving roller assembly for advancing said packaging blanks, as well as at least one rotatable slitting roller with at least one knife for producing a front edge slit and/or a rear edge slit in each packaging blank.

BACKGROUND ART

A packaging machine of this type is known which includes a driving roller assembly and slitting knives, but this machine does not operate completely satisfactorily because it is rather complicated and operates in a rather unreliable manner. In addition, this machine is rather expensive to manufacture.

DISCLOSURE OF INVENTION

The object of the invention is to provide a machine of the above type which even at a high working speed is more reliable than hitherto known, and which in addition is inexpensive to manufacture.

The machine according to the invention is characterised in that the knife is circular, i.e. sector-shaped, and defined by two knife edges, said knife extending across a central angle v of max. 300°, whereby said knife presents a gap between the edges, and that a portion of said knife adjacent the first knife edge is adapted to cut the front edge slit out of the front edge of said blank by means of the slitting roller and a driving motor connected to said slitting roller as well as by means of the controlling programme timer, whereas a second portion of the knife adjacent the other knife edge is adapted to cut the rear edge slit out of a location on the blank adjacent the rear edge of said blank and rearwards through said rear edge by means of said slitting roller, said driving motor and said programme timer while said blank is advanced through the machine at a uniform speed. The resulting operational reliability is very high even at a high working speed, and the resulting slits present sharply cut edges. The machine is furthermore relatively inexpensive to manufacture. While each blank is advanced, the knife turns clockwise during the cutting procedure, but when the rear edge slit has been completed, said knife is turned counterclockwise until the first knife edge reaches its initial position and is ready to receive a subsequent blank.

According to the invention, the knife may be adapted to turn the knife edge out of an initial position by means of the slitting roller, the associated driving motor and the controlling programme timer in connection with the production of the front edge slit, in which position the knife edge is positioned at a predetermined central angle x (the $$\text{arc}\frac{\pi}{180}\cdot rx)$$

from radius to the cutting site substantially corresponding to the desired slit length; and a central angle x forwards until the front edge slit has been cut, whereafter said knife is retarded when the knife gap is positioned above the blank, and where the knife edge of said second knife portion or additional knife may be adapted also by means of said slitting roller, said driving motor and said programme timer to be turned from an initial angular position y and downwards into the blank at the cutting site for the production of the rear edge slit and subsequently be turned a segment corresponding to the length of the rear edge slit of said blank, whereafter said second knife portion is retarded and then turned forwards in such a manner that the first knife edge reaches its initial position and is ready to receive a subsequent packaging blank. As a result, a very high operational reliability is obtained even at a high working speed, and the slits present sharply cut edges. The machine is furthermore relatively inexpensive to manufacture.

During the cutting of both the front edge slit and the rear edge slit, the knife may according to the invention be adapted to run at a peripheral speed which is identical with the advancing speed of the packaging blank by means of the slitting roller, the driving motor and the programme timer. As a result a particularly high operational reliability is obtained.

Furthermore, according to the invention the knife may by means of the slitting roller, the driving motor and the programme timer be adapted to ensure that during the retarding movement the peripheral speed of said knife is finally zero. In this manner the machine operates intermittently with the result that energy is saved during the operation of said machine.

According to the invention the knife may extend across a central angle v of max. 270°, especially 225°, and the angle x may be in the range 30°<x<70°, and the angle y may be in the range 30°<x<70°, which corresponds to a knife gap of more than 90°, especially 135°, said gap size turning out to be advantageous in practice.

Moreover, the driving motor may according to the invention be a servomotor, such as an electric step motor or a mechanical/hydraulic driving motor, which turned out to be particularly advantageous in practice.

When seen in the advancing direction of the packaging blanks, at least one sensor device may according to the invention be mounted before the slitting rollers for detecting the entering of said packaging blanks, said sensor device being adapted to activate the programme timer on arrival of a packaging blank. As a result an increased operational reliability is obtained.

According to the invention a back-pressure roller may be provided below the slitting roller, said back-pressure roller for instance including two relatively thin circular disks interspaced a distance corresponding to the thickness of the knife. The resulting edges cut in the front edge slit and the rear edge slit, respectively, are very sharp.

Finally, the back-pressure roller arranged below the slitting roller may according to the invention be provided with a resilient coating, preferably a rubber coating, whereby a particularly reliable operation is obtained.

BRIEF DESCRIPTION OF THE DRAWINGS

The invention is explained in detail below with reference to the drawings, in which.

BEST MODE FOR CARRYING OUT THE INVENTION

Figure 1:
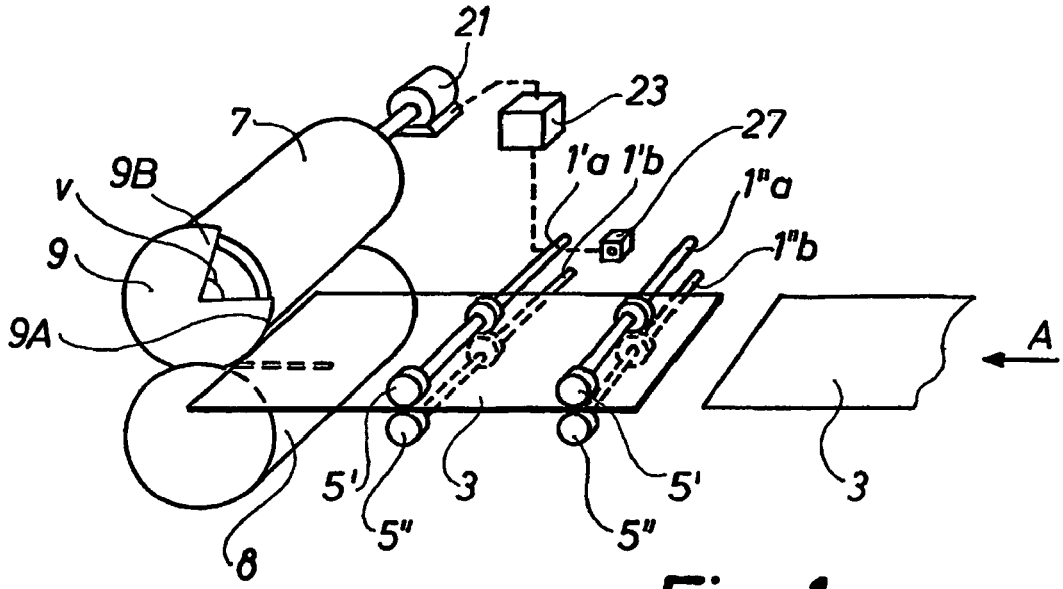
FIG. 1 is a diagrammatic view of an embodiment of a portion of the machine according to the invention.

The machine shown in FIG. 1 is suited for slitting plane packaging blanks, especially packaging blanks made of corrugated board, but it can also be used for blanks made of cardboard. The machine includes a driving roller assembly for advancing aligned packaging blanks 3 in the direction A through the machine. The driving roller assembly includes several, sets of shafts 1'*a*, 1'*b*, 1"*a* and 1"*b*. Cylindrical friction members are placed on these shafts and co-operate in pairs, such as 5' and 5". These friction members are preferably made of plastics or rubber.

Figure 5:
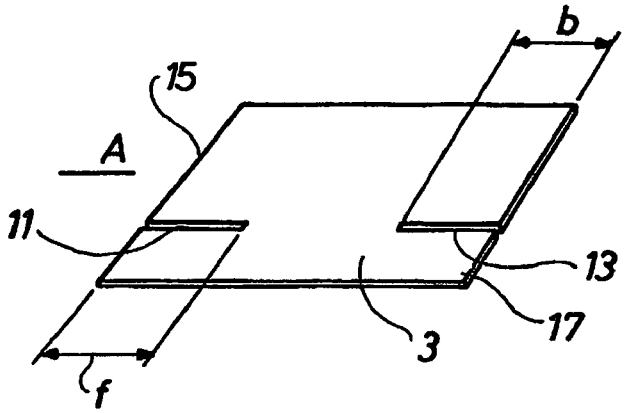
FIG. 5 is a perspective view of a blank provided with a front edge slit and a rear edge slit.

In addition, the machine includes at least one rotatable slitting roller 7, which is provided with at least one knife 9 for cutting a front edge slit 11 or a rear edge slit 13 in the blank, cf. the blank 3 shown in FIG. 5.

The slitting knife 9 is circular and defined by two knife edges 9*a* and 9*b*. The first knife edge 9*a* is arranged at a first knife portion 9A, and the second knife edge 9*b* is arranged at a second knife portion 9B. The knife extends across a central angle v of max. 300° with the result that the knife presents a knife gap 19 between the knife edges 9*a* and 9*b* of at least 60°.

Figure 2:
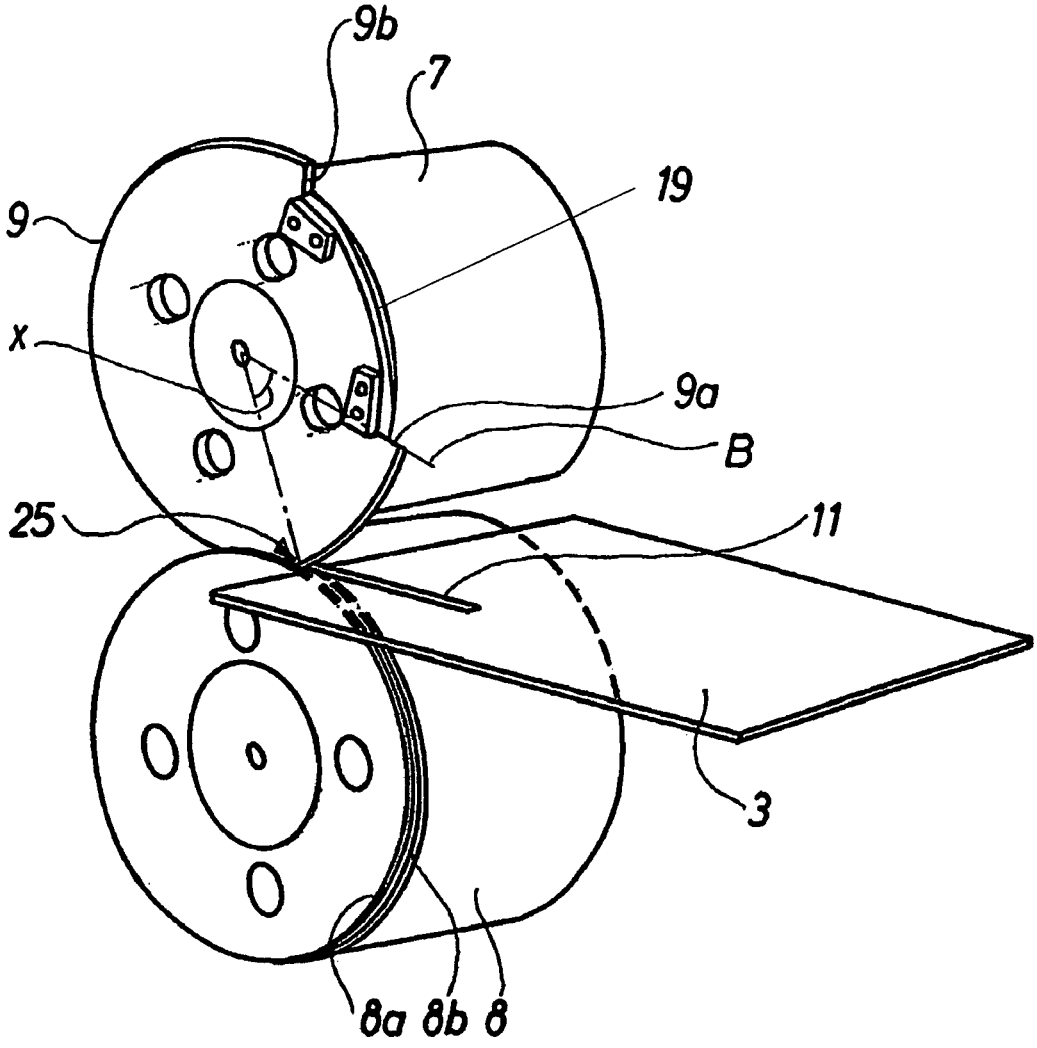
FIG. 2 is a perspective view of the embodiment of FIG. 1, where the first knife edge of the knife is in its initial position and is ready to cut a front edge slit in a packaging blank, FIG. 3 corresponds to FIG. 2, but here the front edge slit of the blank has been cut and the gap of the knife is positioned above said blank, FIG. 4 corresponds to FIG. 3, but here the cutting of the rear edge slit of the blank has been completed.
Figure 3:
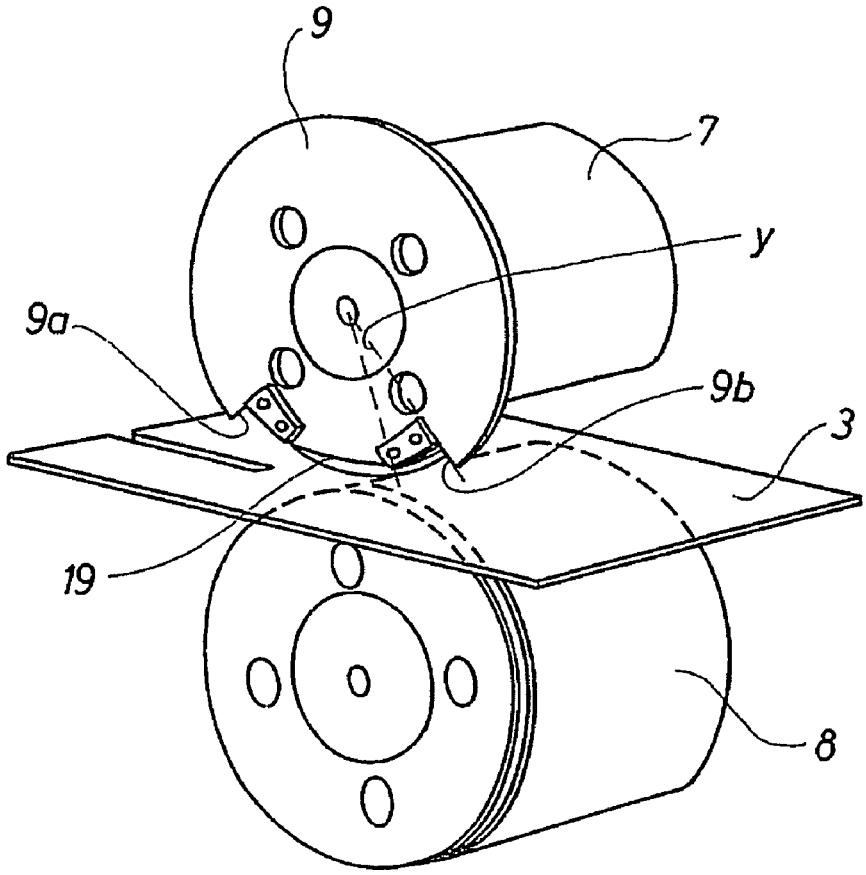

The slitting roller 7 is connected to a driving motor 21 controlled by a programme timer 23, cf. FIG. 1. When a front edge slit 11 is to be produced in the blank 3 where the front edge 15 of the blank has reached the cutting site 25 of the knife, cf. FIG. 2, this programme timer is adapted to turn the knife 9 in such a manner that the first knife edge 9*a* can be turned forwards from an initial position B in which position the knife edge 9*a* is positioned at a predetermined central angle x $$(\text{the arc}\frac{\pi}{180}\cdot rx,$$

where r is the radius of the knife) from radius to the cutting site 25 substantially corresponding to the desired slit length f, cf. FIG. 5, and a central angle x forwards until the front edge slit 11 has been cut, whereafter the programme timer 23 ensures that said knife is retarded when the knife gap 19 is positioned above the blank 3, cf. FIG. 3. During this procedure, the blank 3 is still forced forwards by the driving roller assembly 1'*a*, 1'*b*, 5', 5", cf. FIG. 1, i.e. even when the knife does not engage the blank. In connection with the cutting of the rear edge slit 13 in the blank 3, cf. FIG. 5, the programme timer 23 is adapted to turn the second knife edge 9*b* on the knife portion 9B or on an additional knife not shown out of an initial position y and downwards onto the cutting site 25 and subsequently to turn said knife edge a segment, cf. FIG. 4, corresponding to the length b of the rear edge slit 13 of the blank, cf. FIG. 5. Then the programme timer is adapted to retard the knife and subsequently turn said knife forwards in such a manner that the first knife edge 9*a* reaches its initial position B, cf. FIG. 2, in which the knife 9 is ready to receive a subsequent blank 3.

It is possible to provide the blank 3 with either a front edge slit 11 or a rear edge slit 13 or both slits in one and the same working operation while said blank 3 passes the slitting knife 9. The front edge slit 11 is cut from the front edge 15 of the blank 3 and into said blank, whereas the cutting of the rear edge slit 17 is initiated at a distance from the rear edge of said blank and continued in a rearward direction through the rear edge 17.

During the cutting of both the front edge slit and the rear edge slit, the knife 9 is adapted to run at a peripheral speed which is identical with the advancing speed of the packaging blank 3 by means of the slitting roller, the driving motor and the programme timer. However, nothing prevents the peripheral speed from exceeding the advancing speed of the blank 3 at predetermined moments.

The slitting roller 7, the driving motor 21 and the programme timer 23 allow the knife 9 to be adapted to ensure that during the retarding movement the peripheral speed of said knife is finally zero.

The knife 9 can also extend across a central angle v of max. 270°, especially 225°, whereas the angle x can be in the range 30°<x<70° and the angle y can be in the range 30°<y<70°.

The driving motor 21 can be a servomotor, such as an electric step motor or a mechanical/hydraulic driving motor. It is important that the driving motor can react sufficiently quickly to the command signals of the programme timer 23.

At least one sensor device 27 can be mounted before the slitting roller 7 when seen in the advancing direction A of the packaging blanks 3. This sensor device 27 is adapted to detect the entering blanks 3, and it can for instance be an optical sensor and adapted to transmit an activating signal to the programme timer when a blank 3 passes by. In this manner the first knife edge 9*a* of the knife 9 can be caused to quickly enter its initial position B when said blank 3 reaches the knife 9.

As illustrated in the FIGS. 1 to 4, a back-pressure roller 8 can be provided below the slitting roller 7. This back-pressure roller 8 is for instance provided with two relatively thin, circular disks 8*a*, 8*b* interspaced a distance corresponding to the thickness of the knife. These circular disks are suited for making the edges of the front edge slit 11 and the rear edge slit 13 particularly sharp.

Figure 4:
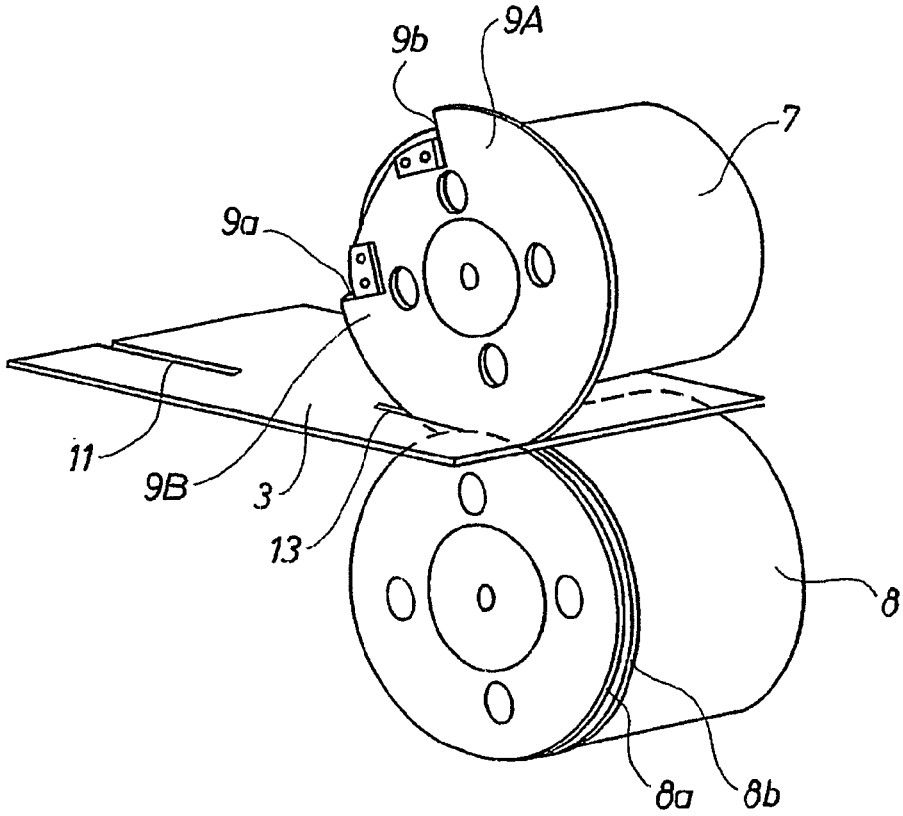

It should be noted that the knife 9 shown in the FIGS. 2 to 4 is rather large and no knife edge is shown, but such a knife edge is, of course, provided in practice.

The back-pressure roller 8 arranged below the slitting roller 7 can be provided with a resilient coating, preferably made of rubber.

Furthermore it should be noted that the knife 9 rotates clockwise during the cutting of both the front edge slit and the rear edge slit, and that the direction of rotation is also clockwise from the moment the rear edge slit has been cut to the moment the first knife edge is in the initial position B. However, it is also possible to turn the knife 9 during the latter procedure so as to rotate counterclockwise in order to cause the first knife edge to enter the initial position B.

The invention may be modified in many ways without thereby deviating from the scope of the invention.

The invention claimed is:

1. A machine for slitting plane packaging blanks made of corrugated board comprising:

a driving roller assembly for advancing said packaging blanks;

at least one rotatable slitting roller with at least one knife for producing a front edge slit and/or a rear edge slit in each packaging blank, said knife being sector-shaped, and defined by two knife end edges, a first knife portion adjacent a first knife end edge being adapted to cut the front edge slit out in a front edge of said blank and a second knife portion adjacent a second knife end edge adapted to cut a rear edge slit out in a rear edge of said blank and rearwards through said rear edge while said blank is advanced through the machine at a uniform speed, wherein the sector-shaped knife extends over a per se known central angle (v) of approx 225-300°;

a driving motor connected to the slitting roller;

a program timer for controlling the driving motor and rotation of the rotatable slitting roller, wherein the program timer controls the driving motor such that the first knife end edge is initially positioned at a predetermined angle (x) from a cutting nip site, the predetermined angle (x) corresponding to a desired slit length taken along an outer radial edge of the slitting roller, where the arc π/180 rx and r is the radius of the knife, and when the front edge of the blank has reached a cutting site the program timer turns the rotatable slitting roller forward until the front edge slit has been cut, and wherein said knife is retarded when a knife gap is positioned above the blank and wherein the rotatable slitting roller is turned such that the second knife end edge of said second knife portion is turned from an initial angular position (y) and downwards into the blank at the cutting site for the production of the rear edge slit, and is subsequently turned an arc substantially corresponding to a length (b) of the rear edge slit of said blank, where said second knife end edge is retarded and then turned in such a manner that the first knife end edge reaches the initial position ready to make slits in a subsequent packaging blank;

a back-pressure roller having a resilient coating comprising rubber provided below the slitting roller, said back-pressure roller including two relatively thin, circular disks interspaced a distance corresponding to the thickness of the knife, the knife extending a distance into the space between the two circular disks and forming the cutting nip site; and at least one sensor provided upstream of said at least one rotatable slitting roller for detecting said packaging blanks and for activating said at least one rotatable slitting roller accordingly.

2. A machine as claimed in claim 1, characterised in that by means of the slitting roller (7), the driving motor (21) and the programme timer (23), the knife (9) is adapted during the cutting of both the front edge slit (11) and the rear edge slit (13) to run at a peripheral speed which is substantially equal to the advancing speed of the packaging blank (3).

3. A machine as claimed in claim 1, characterised in that by means of the slitting roller (7), the driving motor (21) and the programme timer (23), the knife (9) is adapted to ensure that during the retarding movement the peripheral speed of said knife (9) is finally zero.

4. A machine as claimed in claim 1, characterised in that the central angle (x) is in the range $30° < x < 70°$, and the angle (y) is in the range $30° < y < 70°$.

5. A machine as claimed in claim 1, characterised in that the driving motor (21) is a servomotor.

6. A machine as claimed in claim 1 wherein the driving motor (21) is an electric step motor.

7. A machine as claimed in claim 1 wherein the driving motor (21) is a mechanical/hydraulic driving motor.

* * * * *